US010465426B2

(12) United States Patent
Alfredsson

(10) Patent No.: US 10,465,426 B2
(45) Date of Patent: Nov. 5, 2019

(54) LOCKING MECHANISM

(71) Applicant: Industrilås i Nässjö Aktiebolag, Nässjö (SE)

(72) Inventor: Bengt-Åke Alfredsson, Bodafors (SE)

(73) Assignee: Industrilås i Nässjö Aktiebolag, Nässjö (SE)

( * ) Notice: Subject to any disclaimer, the term of this patent is extended or adjusted under 35 U.S.C. 154(b) by 402 days.

(21) Appl. No.: 15/509,792

(22) PCT Filed: Sep. 9, 2015

(86) PCT No.: PCT/EP2015/070553
§ 371 (c)(1),
(2) Date: Mar. 8, 2017

(87) PCT Pub. No.: WO2016/038066
PCT Pub. Date: Mar. 17, 2016

(65) Prior Publication Data

US 2017/0284137 A1 Oct. 5, 2017

(30) Foreign Application Priority Data

Sep. 9, 2014 (EP) ..... 14184090

(51) Int. Cl.
*E05C 9/04* (2006.01)
*E05C 5/00* (2006.01)
(Continued)

(52) U.S. Cl.
CPC ..... *E05C 9/04* (2013.01); *E05B 17/0025* (2013.01); *E05C 5/00* (2013.01); *E05C 9/18* (2013.01)

(58) Field of Classification Search
CPC ..... E05C 9/1875; E05C 19/14; E05C 9/04; E05C 9/16; E05C 9/1883; Y10T 292/106;
(Continued)

(56) References Cited

U.S. PATENT DOCUMENTS 2,874,986 A * 2/1959 Henrichs ..... E05C 1/145 292/167
4,583,442 A * 4/1986 Minor ..... G10D 13/023 292/113
(Continued)

FOREIGN PATENT DOCUMENTS

DE 484219 C 10/1929
GB 2210098 A 6/1989
GB 2214561 A 9/1989

OTHER PUBLICATIONS

International Search Report and Written Opinion for International Application No. PCT/EP2015/070553, dated Nov. 17, 2015 (9 pages).

*Primary Examiner* — Mark A Williams
(74) *Attorney, Agent, or Firm* — Kagan Binder, PLLC

(57) ABSTRACT

The present invention relates to a locking mechanism for arrangement on a door, the locking mechanism (1) comprising an actuator (10), arranged to be linearly movable along a first axis (Y). The locking mechanism further comprises a locking clamp (20) for engaging a locking element (50) on a door frame. The locking clamp (20) may be flexibly coupled to the actuator (10) so that, when the actuator (10) is moved along the first axis, the locking clamp (20) may move linearly along the first axis (Y) and rotate around a first rotational axis (A) to admit engagement to the locking element. The present invention further relates to a locking system (100) comprising such locking mechanism (1).

10 Claims, 5 Drawing Sheets

(51) Int. Cl.
*E05C 9/18* (2006.01)
*E05B 17/00* (2006.01)

(58) Field of Classification Search
CPC ..... Y10T 292/0805; Y10T 292/0803; Y10T 292/0933; Y10T 292/1078; Y10T 292/0859; Y10T 292/0863; Y10T 292/0972; Y10T 292/1053; Y10T 292/1071; Y10S 292/37
See application file for complete search history.

(56) References Cited

U.S. PATENT DOCUMENTS

| | | | | |
|---|---|---|---|---|
| 5,165,148 | A * | 11/1992 | Fleischer | B25B 5/12 24/494 |
| 5,667,261 | A * | 9/1997 | Weinerman | E05C 19/14 292/113 |
| 6,981,724 | B2 * | 1/2006 | Denys | E05B 63/24 292/64 |
| 8,398,126 | B2 * | 3/2013 | Nakanishi | E05B 63/185 292/1.5 |
| 8,550,506 | B2 * | 10/2013 | Nakanishi | E05B 63/185 292/162 |
| 2001/0026070 | A1 | 10/2001 | Schlack et al. | |
| 2011/0260474 | A1 * | 10/2011 | Sambommatsu | E05C 19/022 292/178 |

* cited by examiner

LOCKING MECHANISM

CROSS-REFERENCE TO RELATED APPLICATIONS

This application claims priority to International Application No. PCT/EP2015/070553, filed Sep. 9, 2015, and titled "LOCKING MECHANISM", which in turn claims priority from European Application having Ser. No. 14/184,090.0, filed on Sep. 9, 2014, both of which are incorporated herein by reference in their entireties.

TECHNICAL FIELD

The present invention relates to a door lock mechanism and in particular to a locking mechanism suitable for use in an enclosure.

BACKGROUND

In the field of locks for doors, cabinets and windows, a common solution is the use of espagnolettes. A common type of espagnolettes use a double acting twist technology, where a vertically mounted elongated rod have a peg horizontally mounted across the rod at both ends so when the rod, maneuvered via a handle, is twisted, the pegs are engaged in a corresponding slot in a door frame for instance. This solution brings a simple arrangement with two locking points, which may be attractive due to the sense of stability of light weight doors, as well as it brings a relatively secure arrangement. However, this type of espagnolette is mainly operated from the inside and in many occasions, for instance in the case of cabinet locks, there is a need for an espagnolette type solution that secures the door from the outside. A solution to this may be an elongated rod situated inside a cabinet, maneuvered from the outside. When maneuvered, a locking mechanism on each end of the rod is slid into a receiving end in the door frame. However, in the case of for instance electrical enclosures or enclosures that contain moving mechanical equipment, that often are manufactured from thin sheet metal, the need for a tight arrangement that ensures that the enclosure does not rattle is of high importance. Therefore there is a need for a stable locking arrangement that ensures a tight connection.

SUMMARY

It is an object of the present invention to provide an improved solution that alleviates the mentioned drawbacks with present devices. Furthermore it is an object to provide a locking mechanism with a more precise locking. Moreover it is an object to provide a locking system.

The invention is defined by the appended independent claims. Embodiments are set forth in the dependent claims, in the following description and in the drawings.

The invention is based on the inventor's realization that by providing a locking mechanism comprising an actuator and a locking clamp, by having guide means that may bring the locking clamp into a closed position by a linear and a rotational movement to engage a locking element, a locking mechanism with a precise locking technique and a securely tight arrangement may be achieved.

According to a first aspect of the invention, there is provided a locking mechanism for arrangement on a door, the locking mechanism comprising an actuator, arranged to be linearly movable along a first axis. The locking mechanism further comprises a locking clamp for engaging a locking element on a door frame. The locking clamp may be flexibly coupled to the actuator so that, when the actuator is moved along the first axis, the locking clamp may move linearly along the first axis and rotate around a first rotational axis to admit engagement to the locking element.

When the locking mechanism is to be locked, the actuator may be pushed in a locking direction, along the first axis, so that a locking clamp may indirectly be pushed in the same direction. The locking clamp may then perform a rotation, for a precise predetermined movement, towards a locking element on a corresponding door frame, and subsequently engage with the locking element. Thus, the locking mechanism, which may be mounted on the inside of a door, may engage with a locking element on the door frame, also facing inwards, so that the locking mechanism tightly compresses the door between the locking clamp and the door frame. This may ensure a secure locking, due to the predetermined movement, and leaves the locking mechanism tight and free from unwanted movement since the size of any gaps present that may cause rattle may be reduced due to the precise positioning and the firm compression.

Furthermore, upon unlocking of the locking mechanism, the locking clamp may be pulled via the actuator, performing the rotation in the opposite direction and thereby releasing the grip from the locking element.

The linear movement and the rotational movement of the locking clamp may be performed in sequence or simultaneously. If performed in sequence, the linear movement may in one embodiment be performed before the rotational movement and in another embodiment after the rotational movement. Further, the linear and rotational movements may be performed simultaneously, but started and/or completed sequentially. The linear movement of the locking clamp may be completed before final engagement with the locking element by rotation of the locking clamp in order to reduce any energy loss that may arise from any friction at the time of engagement. That is, the linear movement may be completed before the rotational movement is completed. The final engagement of the locking clamp towards the locking element may involve a compression so that a tight engagement may be ensured. The linear and rotational movement may have brought the locking clamp as close to the final position over the locking element as possible before contact between the two, so that any friction losses upon final engagement are avoided. The actuator may be moved by means of a rod which is maneuvered by a handle. The handle may be placed on the outside of a cabinet or an enclosure, and the locking mechanism may be placed on the inside of the cabinet door. The locking mechanism may be arranged close to one of the door's edges, so a locking element on a corresponding door frame is comfortably within reach of the locking mechanism. The locking mechanism may be arranged in any direction suitable on the door. In other words, the locking mechanism may be placed so that the first axis may be directed in any direction suitable for the specific installation. It may be horizontal, vertical or angled with respect to the cabinet door. By flexibly coupled it may be meant a direct or indirect connection between the actuator and the locking clamp that allows a movement of the locking clamp relative to the actuator.

According to one embodiment of the invention, the first rotational axis may be perpendicular to the first axis.

The rotation that results from the movement of the locking clamp may be directed around a rotational axis perpendicular to the first axis. The rotational axis may also preferably be parallel with the plane that is formed by the bottom side of the locking mechanism. This may result in a three dimensional movement of the locking mechanism, since the rotation is performed in an outwards manner, starting from the actuator end, and leaping towards the locking element. By letting the locking clamp perform a rotation of this kind, it may be possible to direct the locking clamp towards the locking element in a precise manner with less need of safety margins and thereby reduce gaps that may cause rattle. Also, by the accurate linear positioning, any loss in energy due to friction upon engagement may be reduced.

According to another embodiment, the locking mechanism further comprises guide means which may be arranged to guide the locking clamp to perform a linear and rotational movement to admit engagement to the locking element. The guide means may comprise at least a first guide slot for receiving a corresponding first guide pin.

By having guide means to direct the locking clamp towards the locking element it is possible to ensure a precise movement for the specific installation and hence a secure locking. The guide means may be a set of guide pin and guide slot, mutually arranged on the locking mechanism. The guide slot may be of any shape, for instance straight or curved, to allow the locking clamp to move in any direction suitable. The guide slot may be associated with a corresponding guide pin. It may also be possible with another type of guiding means, for instance rail or wire.

According to another embodiment, the locking mechanism further comprises a support. The support may comprise a first wall, and the first guide slot may be arranged in the first wall.

The support may be arranged so that it provides support and stability for the actuator and the locking clamp, which may be allowed to move relatively to the support. The support may be arranged for mounting on the door directly with at least one fastener, such as a screw or rivet, or possibly other fastening means such as glue. The support may be provided with a pin, a bolt or the like, and the actuator may be provided with a linear channel, in which the pin may be positioned. The pin and channel may facilitate linear movement of the actuator. It may be possible that a fastener of the support may provide the function as the pin, arranged to allow linear movement of the actuator.

According to another embodiment, the locking mechanism further comprises an intermediate link arranged between the actuator and the locking clamp.

By providing an intermediate link to the locking mechanism, further flexibility may be provided to the linear and rotational movement. The intermediate link may be of a suitable size, connecting the actuator and the locking clamp, to facilitate the rotational movement of the locking clamp while the actuator may stay parallel with the first axis.

According to yet another embodiment, the intermediate link may be rotationally coupled to each of the locking clamp and the actuator via a first and second joint respectively.

By allowing the intermediate link to be rotationally connected to each of the actuator and the locking clamp, it may allow the locking clamp to be moved more freely with less restriction from the actuator. For example it may allow the locking clamp to perform a rotation along a circle with a wider radius, which may be necessary depending on the position of the locking element. Further, the intermediate link and its rational connections to the locking clamp and the actuator may be designed to provide the desired linear and rotational movement of the locking clamp as a result of the linear movement of the actuator.

According to one embodiment, the first guide pin is arranged on the intermediate link. The movement of the intermediate link may thereby be controlled by the first guide pin and the first guide slot to provide the desired movement of the locking clamp.

According to another embodiment, the locking mechanism further comprises a second guide pin located on the locking clamp and extending along the rotational axis. The first and second guide pins may each be associated with a corresponding first and second guide slot in the support.

By providing the locking clamp with a guide pin, the rotation may be controlled. Upon linear movement by the actuator, one end of the locking clamp may be pushed, and due to the intermediate link and the second guide pin, a rotation around the second guide pin may be achieved. By providing the locking mechanism with two guide pins, each guide pin may be guided in a respective guide slot to control the movement. For instance, since the intermediate link is rotationally connected to the actuator and the locking clamp it may be an advantage to be able to guide each rotation in order to avoid unnecessary wobble.

According to another embodiment, the first guide pin may be placed in the first joint between the intermediate link and the locking clamp.

By having the two guide pins placed in the first joint and on the locking clamp respectively, the movement of the intermediate link may be controlled by the guide pin placed in the first joint, and the movement of the locking clamp may be controlled by the guide pin placed on the locking clamp. Together with the corresponding guide slots, they may be designed to perform any movement suitable for the specific installation.

According to another embodiment of the invention, the first guide slot may extend along an axis at an angle from the first axis, and the second guide slot may extend in a direction parallel to the first axis.

The guide slots may be designed for the locking mechanism to perform any desired movement in a precise manner. By having the second guide slot extend along an axis parallel to the first axis, the locking clamp may be moved linearly via the second guide pin as the actuator moves linearly. By having the first guide slot extend in an angle outwards, the first guide pin may be moved along that path. The combination of the two guide slots may allow the locking mechanism to move linearly to reach the locking element which may be placed on a door frame. Simultaneously or almost simultaneously as the second guide pin is moved along the second guide slot, the first guide pin is moved along the first guide slot, rotating the locking clamp as the locking clamp may be forced to rotate around the rotational axis. The length and the direction of the guide slots may determine the exact path for the locking clamp and may therefore allow a precise movement with fewer gaps. The guide slots may be formed to provide a movement of the locking clamp wherein the locking clamp first moves linearly and then in series rotates around the first rotational axis.

According to another embodiment, the support further may comprise a second wall. The second wall may be symmetrically arranged over the first axis on each side of the actuator. The second wall may be a mirrored duplicate of the first wall, defining a first, or a first and a second, mirrored guide slot, wherein the first, or first and second, guide pins may extend through the locking mechanism symmetrically, so that the extended guide pins may be associated with the guide slots in the first and second wall.

By letting the locking mechanism comprise symmetrically arranged guide pins and guide slots, it may further ensure a stable locking mechanism. The first wall may then be mirrored symmetrically relative the first axis. The guide slots may be arranged similarly on the locking clamp and the intermediate link respectively, so that they may be associated with the mirrored guide slots. It is however a possibility that the first wall of the support may be arranged in line with the first axis, in other words extending across the middle of the locking clamp, and that the guide slots are arranged on corresponding positions on the intermediate link and the locking clamp, or anywhere suitable to allow a desired movement of the locking mechanism.

According to another embodiment, the support may be arranged to be fixedly mounted on a door.

The support may be mounted on a door, preferably so that the bottom side of the locking mechanism is arranged on or offset to the door surface. The support may thus provide stability to the locking mechanism, and may allow the actuator move freely along a predetermined channel. The support may be fixedly arranged with fasteners, such as screws, bolts, rivets or the like. It may also be a possibility to fix the support with glue, weld, solder or anything suitable for the specific installation.

According to the embodiment, the locking clamp comprises engagement means for engagement to a locking element. The engagement means comprises any of the following: a hook, a clamp, a loop, a pin, a magnet.

Since the locking clamp may be arranged to engage with a corresponding locking element, the engagement means may be designed in a number of ways depending on the specific installation. Any engagement means are thus designed to suit the specific installation and current demands. The engagement means may be designed as a sharp edge, arranged to engage with a corresponding edge on the locking element.

According to a second aspect of the invention a locking system for arrangement on a door is provided. The locking system may comprise at least a first locking mechanism, a handle, and a first elongated rod. The first elongated rod may be arranged to be linearly movable. The first elongated rod may be operable via the handle. The rod may be coupled to the locking mechanism and arranged so that when the first elongated rod may be linearly movable and may be operable via the handle. The rod may be coupled to the locking mechanism and arranged so that when it is moved, it moves the actuator to perform a linear and rotational movement for engagement with the locking element on a door frame.

According to one embodiment of the invention, the locking system further comprises a second locking mechanism, arranged on a second elongated rod. The second elongated rod may be maneuvered via the handle and movable in an opposite direction from the first elongated rod. Upon maneuvering of the handle, the first and second locking mechanisms may move mutually in opposite directions to engage with respective corresponding first and second locking elements on a door frame.

BRIEF DESCRIPTION OF THE DRAWINGS

The invention will in the following be described in more detail with reference to the enclosed drawings, wherein.

DETAILED DESCRIPTION OF EMBODIMENTS

Figure 1:
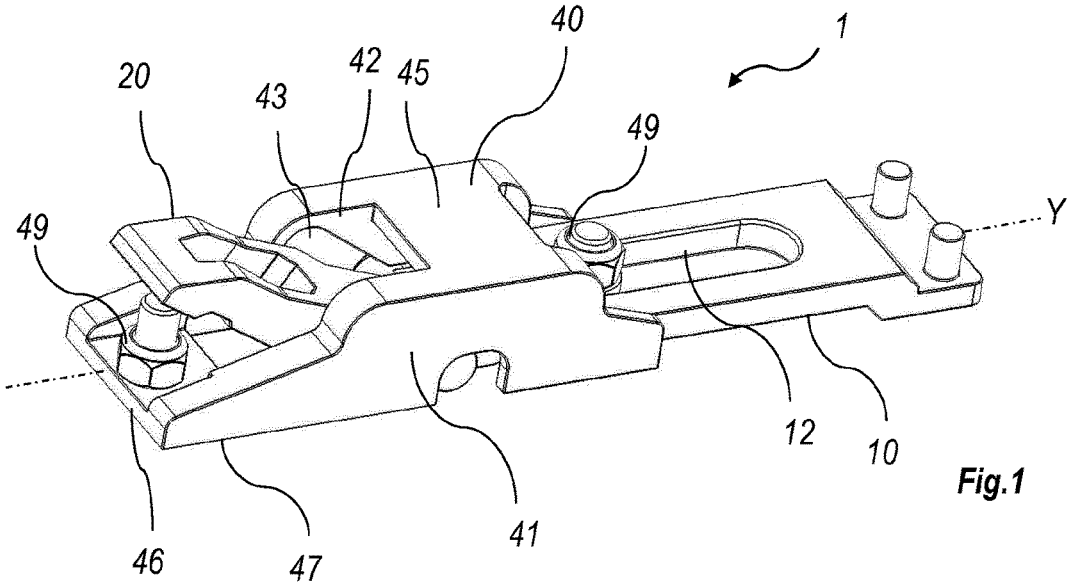
FIG. 1 is a perspective view of a locking mechanism according to an embodiment of the invention, in an unlocked position.

The present invention will be described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. In the drawings, like numbers refer to like elements.

The locking mechanism 1 according to the invention is described in FIG. 1. The locking mechanism 1 is shown in an unlocked position. The locking mechanism 1 comprises an actuator 10 and a locking clamp 20. FIG. 1 further shows a support 40 which comprises a bottom plate 47 and a first wall 41 and a second wall 42. The first and second walls 41, 42 are further connected with a top 45 that covers a part of the moving parts of the locking mechanism. The bottom plate comprises a front edge 46 and fasteners 49 to enable mounting on a cabinet door. The locking mechanism 1 is thereby arranged to be fixedly mounted on a cabinet door or the like, with the bottom 47 facing the door. The fasteners 49 in FIG. 1 are screws and nuts, but any other suitable type of fasteners may be used, such as rivets, pins, glue or magnets. The fasteners 49 are placed centrally along a first axis Y.

In FIG. 1 it is shown that the actuator 10 comprises a channel 12, in which a fastener 49 sit, which enables the actuator 10 to move linearly along the first axis A. The actuator 10 is thereby held in place by the support 40 between the first and second wall 41, 42 and the fastener 49 which admits the linear movement. It is a possibility that the support may have other type of fastening than screws and nuts and possibly in another place than along the first axis Y, which also would bring that the channel may run around some other type of pin that admits the linear movement.

Figure 2:
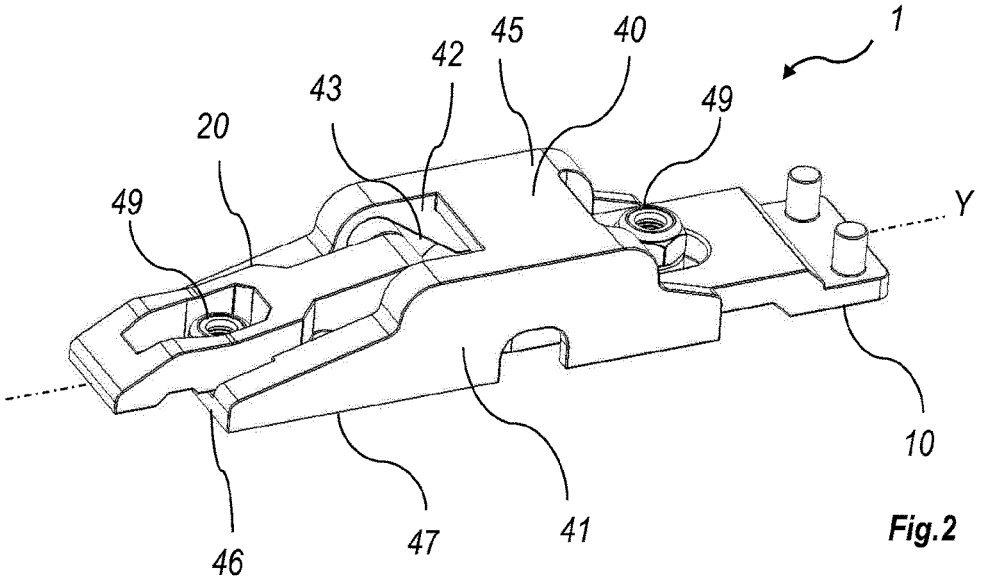
FIG. 2 is a perspective view of a locking mechanism according to an embodiment of the invention, in a locked position.

FIG. 2 shows a locking mechanism in a locked position. It is here shown that the actuator 10 has moved in the channel from a position further from the locking clamp 20, to a position closer to the locking clamp 20 along the first axis Y. The locking clamp 20 has then moved linearly passed the front edge 46 of the support 40. The support 40 is formed to prevent the actuator 10 from moving in any other direction than linearly along the first axis Y.

Figure 3:
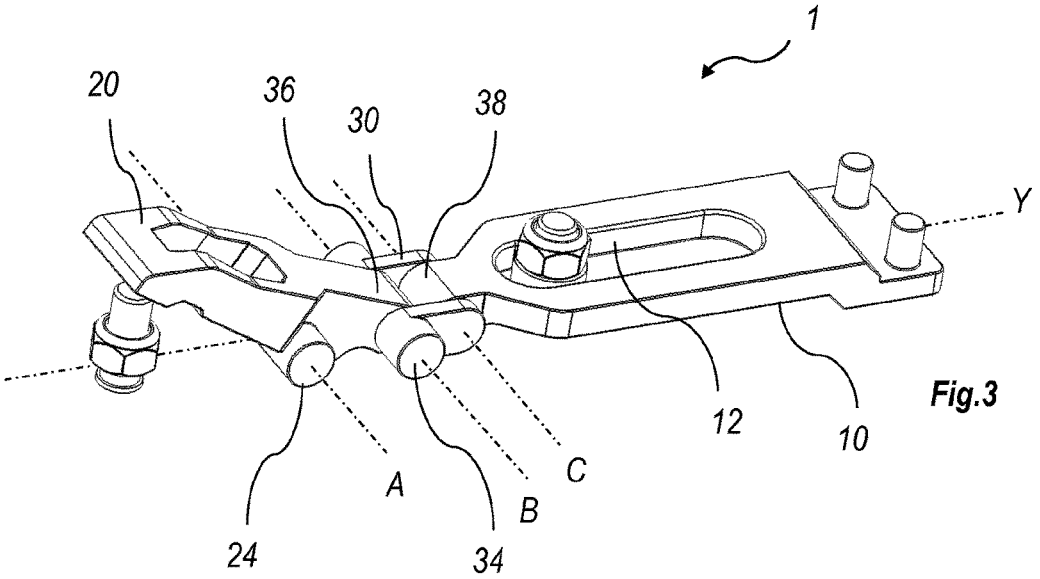
FIG. 3 is a perspective view of a locking mechanism according to an embodiment of the invention, in an unlocked position, with no support.
Figure 4:
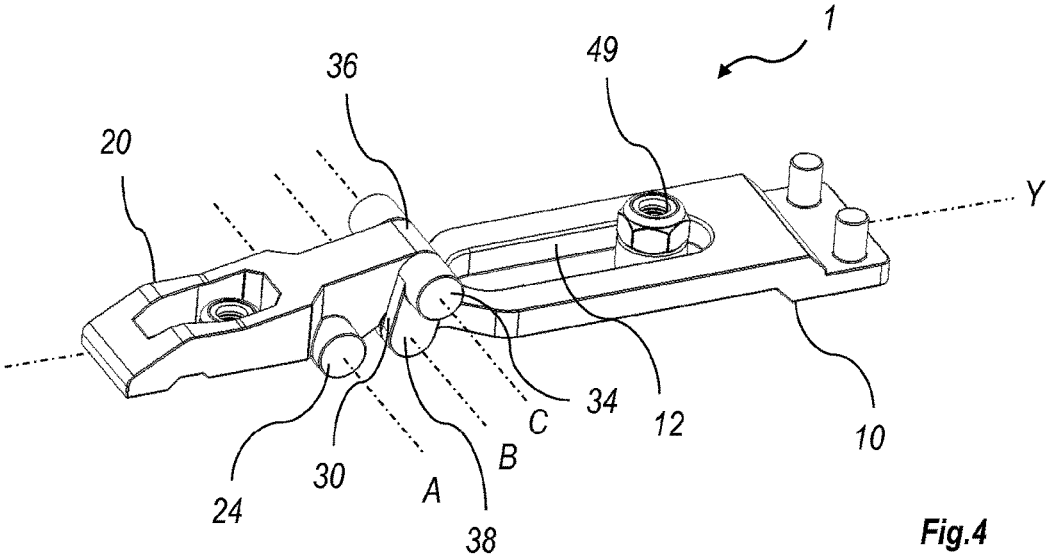
FIG. 4 is a perspective view of a locking mechanism according to an embodiment of the invention, in a locked position, with no support.

In FIGS. 3 and 4, the moving parts of the locking mechanism 1 are shown in more detail. FIG. 3 shows the locking mechanism 1 in an unlocked position. There is shown the actuator 10 and the locking clamp 20 connected to an intermediate link 30 which is rotatably connected to each of the locking clamp 20 and the actuator 10 via a first and second joints 36, 38 respectively. The first joint 36 is rotatable around a second axis B, and the second joint 38 is rotatable around a third axis C. In the first joint 36, there is a first guide pin 34, extending through the joint. On the locking clamp 20, there is a second guide pin 24, extending through the locking clamp 20. The guide pins 34, 24 are arranged to enable movement along a predetermined path defined by corresponding first and second guide slots 43, 44 in the first and second walls 41, 42 (see FIGS. 5 and 6). In FIG. 3, it is shown that when the locking mechanism 1 is in an unlocked position, the locking clamp 20 is open, and released from engagement with a locking element. It is also shown that each guide pin 34, 24 are in a position in each respective guide slot 43, 44 in a plane parallel with the first axis Y, when the locking mechanism is unlocked. This plane may also be parallel with a door surface onto which the locking mechanism may be fixed, and/or parallel with the bottom surface 47 of the support 40.

In FIG. 4, the locking mechanism 1 is shown in a locked position. It is shown that the actuator 10 is moved relative to the fasteners 49 in the channel 12, and thereby forcing the locking clamp 20 into a closed position. It is further illustrated in FIGS. 5 and 6 how the movement from an unlocked position to a locked position is done.

Figure 5:
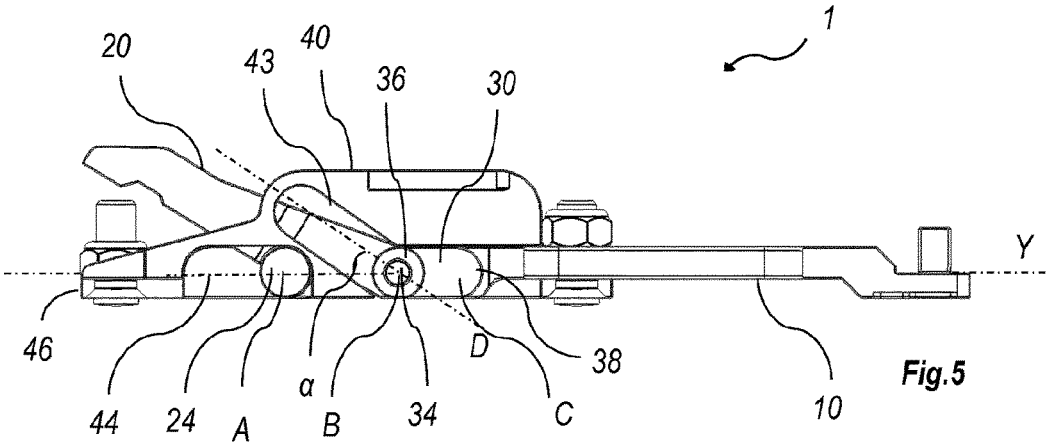
FIG. 5 is a cross-sectional side view of a locking mechanism according to an embodiment of the invention, in an unlocked position.

FIG. 5 is a cross-sectional side view of the locking mechanism 1. FIG. 5 shows the support in cross-section, showing the support being supplied with a first guide slot 43 and a second guide slot 44. The first guide slot 43 extends along axis D at an angle $\alpha$ from the first axis Y, and the second guide slot 44 is parallel to the first axis Y. The axis D further forms an angle $\alpha$ with the bottom surface 47 of the support 40, and/or with a door surface onto which the locking mechanism may be fixed.

Figure 6:
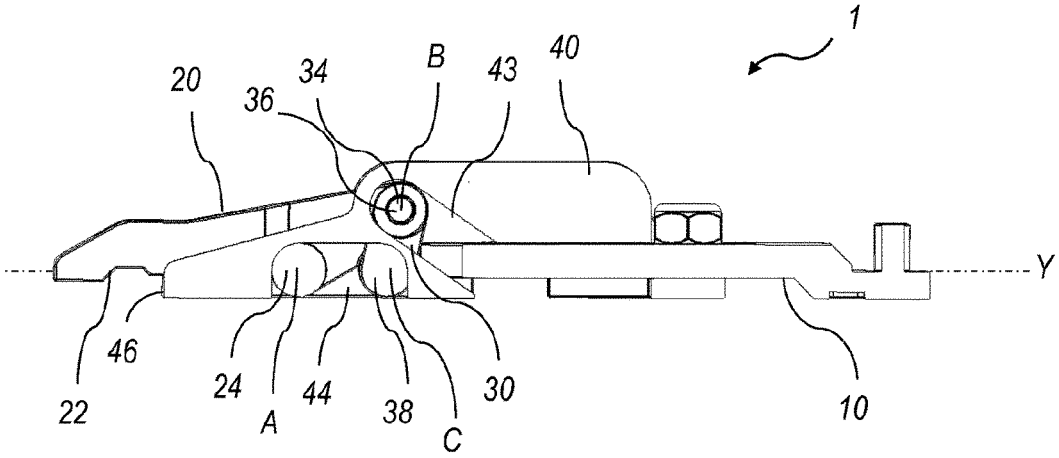
FIG. 6 is a cross-sectional side view of a system of a locking mechanism according to an embodiment of the invention, in a locked position.

In FIG. 5, it is made clear that when in an unlocked position, the first and second guide pins 34, 24 are resting in a position in each respective guide slot 43, 44 in a plane parallel with the first axis Y. Upon movement into a locked position, as shown in FIG. 6, the actuator 10 is moved linearly relative the support 40, which is fixed, and pushes the second joint 38 so that it moves linearly, and in turn pushes the locking clamp 20 linearly along the second guide slot 44. When there is a restriction in any of the linear movements, the first joint 36 with the first guide pin 34 is pushed to move along the first guide slot 43 along axis D at the angle $\alpha$ relative to the first guide slot 43 and first axis Y. This forces the locking clamp 20 to perform a rotation around the second axis A at the second guide pin 24 so that the tip of the locking clamp stretches over a front edge 46 of the support 40 and lowers towards the bottom 47. With this arrangement, the sliding linear movement is completed before the locking clamp is lowered towards the locking element in order to reduce friction. It is however possible that the guide pins 34, 24, in an unlocked position are placed differently, depending on the positions of the guide slots 43, 44. Hence, depending on the specific needs for the installation, the guide slots 43, 44 may be placed arranged and curved differently, all depending on the requirements of the movement of the locking clamp 20.

When the first guide pin 34 moves in the first guide slot 43 along axis D towards the closed position of the locking mechanism 1, the second joint 38 between the actuator 10 and the intermediate link 30 moves linearly along first axis Y. When the locking clamp 20 is in the closed position, as seen in FIG. 6, the second joint 38 is located closer to the rotational axis A along first axis Y than the first joint 36. The second joint 38 is always located in the same plane as the rotational axis A.

Figure 7:
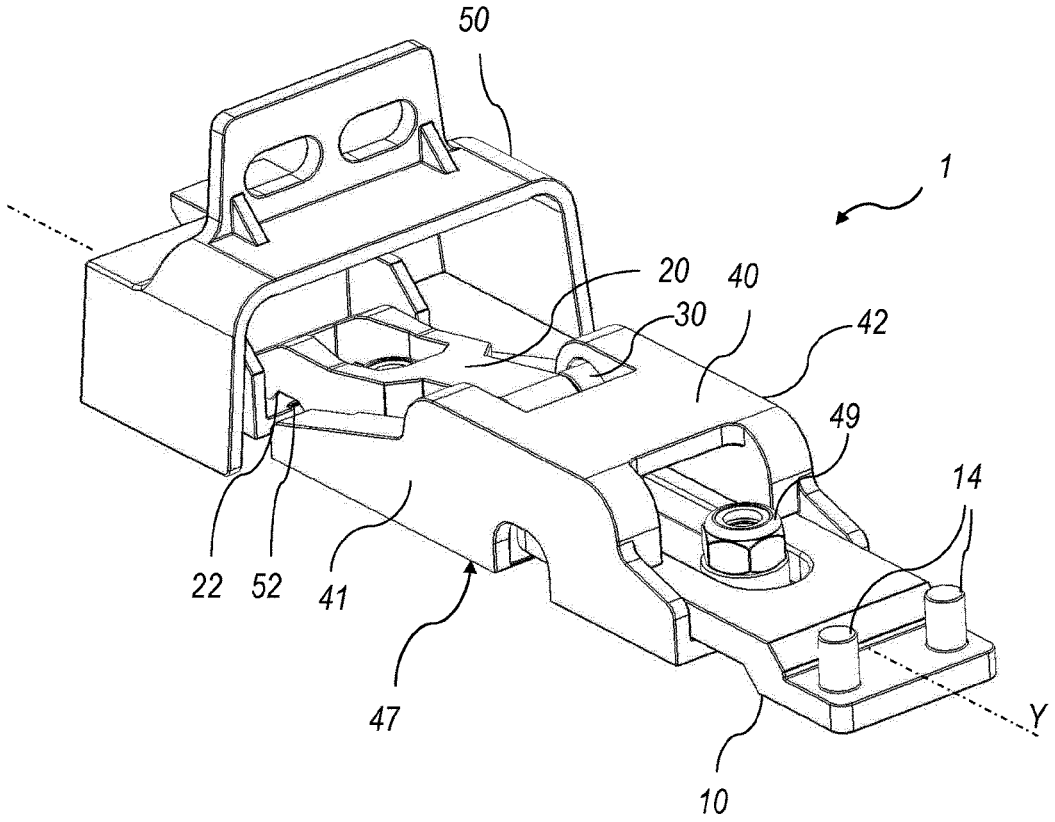
FIG. 7 is a perspective view of a locking mechanism according to an embodiment of the invention, in a locked position engaging a locking element.

FIG. 7 is a perspective view, showing the locking mechanism 1 in a locked position. It also shows a locking element 50, which the locking mechanism 1 engages with to secure the locking. The locking mechanism 1 is supplied with engagement means 22, and the locking element 50 is supplied with a corresponding arrangement 52 for engagement. The engagement means in FIG. 7 is a recess 22 that engages with a corresponding protrusion 52 on the locking element 50. However, the engagement means may be of any suitable type, such as a hook, loop, a pin, magnet or similar.

Figure 8:
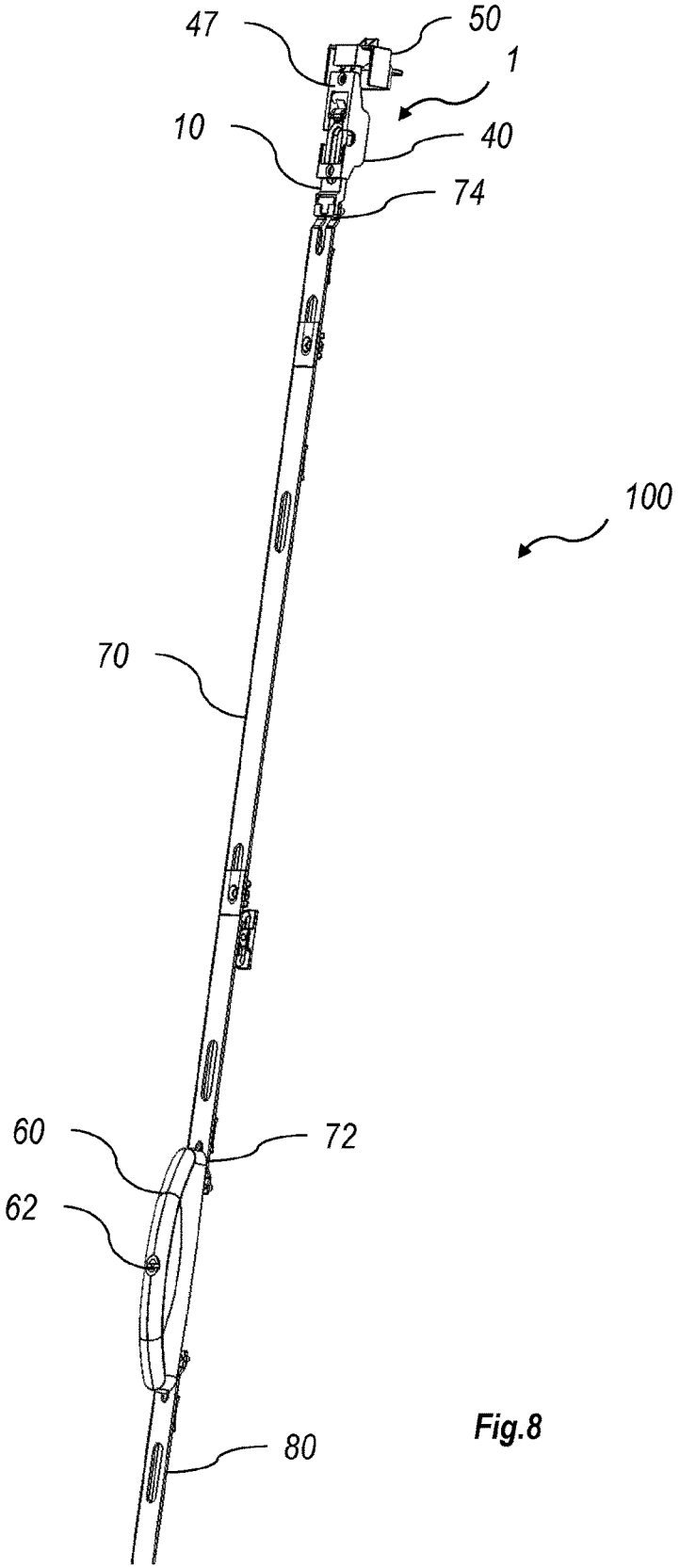
FIG. 8 is a perspective view of a locking system according to an embodiment of the invention.

In FIG. 8, a locking system 100 according to an embodiment of the invention is illustrated. The locking system 100 comprises a locking mechanism 1 as previously described and is arranged to be mounted in a vertical position. The locking system 100 is manoeuvred by a handle 60 and is lockable with a key lock 62. The locking mechanism is operated by the handle via a first elongated rod 70. The system may require a number of elongated rods, or possibly rods of different lengths, depending on the size of the door to be locked. The first elongated rod 70 is connected to the handle via a lower connection 72 and connected to the actuator via an upper connection 74. The actuator comprises pins 14 or the like (see FIG. 7) for connection with the first elongated rod 70. When the handle is manoeuvred, the first elongated 70 rod pushes or pulls the actuator 10 to bring the locking clamp 20 into a locked position or an unlocked position. The locking mechanism may be arranged to be mounted in a vertical position, so that when manoeuvred with the handle, the locking clamp 20 is moved linearly vertically to engage with a locking element at a horizontal doorframe. The key lock 62 may also be of any other type. It may be lacking a lock altogether, or possibly be secured by a pin, a bolt, combination lock or possibly a padlock.

The locking system 100 may be arranged so that the handle may operate two symmetrically arranged locking mechanisms (not shown). A second elongated rod 80 is then connected to the handle so that upon manoeuvring the handle, the first and second elongated rods 70, 80 move in opposite directions in order to operate a respective locking mechanism 1 in each vertical end.

In the drawings and specification, there have been disclosed preferred embodiments and examples of the invention and, although specific terms are employed, they are used in a generic and descriptive sense only and not for the purpose of limitation, the scope of the invention being set forth in the following claims.

The invention claimed is:

1. A locking mechanism for arrangement on a door, the locking mechanism comprising an actuator, arranged to be linearly movable along a first axis, a locking clamp for engaging a locking element on a door frame, thereby locking the door to the door frame, wherein the locking clamp is coupled to the actuator so that, when the actuator is moved along the first axis, the locking clamp moves from an open position towards a locking position by moving linearly along the first axis and rotates around a rotational axis to admit engagement to the locking element, an intermediate link is arranged between the actuator and the locking clamp and rotationally coupled to each of the locking clamp and the actuator via a first and second joint respectively, wherein the locking mechanism further comprises a support and wherein a first guide pin is arranged on the intermediate link and extending into a first guide slot provided on the support, wherein the locking clamp comprises a second guide pin extending into a second guide slot provided on the support, wherein the first guide slot extends along an axis at an angle from the first axis, and the second guide slot extends in a direction parallel to the first axis such that a rotation of the locking clamp around the rotational axis is provided when the first guide pin moves along the first guide slot, and wherein the second joint is configured to move linearly along the first axis and is always located in the same plane as the rotational axis of the locking clamp.

2. The locking mechanism according to claim 1, wherein the rotational axis is perpendicular to the first axis.

3. The locking mechanism according to claim 1, wherein the support comprises a first wall, wherein the first guide slot is arranged in the first wall.

4. The locking mechanism according to claim 3, wherein the support further comprises a second wall, wherein the second wall is a mirrored duplicate of the first wall, the first and second walls being symmetrically arranged on each side of the actuator and defining a first, or a first and a second, mirrored guide slot, wherein the first, or first and second, guide pins extend through the locking mechanism symmetrically, and so that the extended first, or first and second guide pins are associated with the mirrored guide slots.

5. The locking mechanism according to claim 3, wherein the support is arranged to be fixedly mounted on a door.

6. The locking mechanism according to claim 1, wherein the first guide pin is placed in the first joint between the intermediate link and the locking clamp.

7. The locking mechanism according to claim 1, wherein the second guide pin is located on the locking clamp and extends along the rotational axis.

8. The locking mechanism according to claim 1, wherein the locking clamp comprises engagement means for engagement to a locking element, wherein the engagement means comprises any of the following: a hook, a clamp, a loop, a pin, a magnet, a recess.

9. A locking system for arrangement on a door, comprising at least a first locking mechanism according to claim 1, a handle, and an elongated rod, wherein the rod is arranged to be linearly movable, wherein the elongated rod is operable via the handle, wherein the rod is coupled to the locking mechanism and arranged so that when the rod is linearly moved, it moves the actuator to perform a linear and rotational movement for engagement with a locking element on a door frame.

10. The locking system according to claim 9, wherein the locking system further comprises a second locking mechanism, arranged on a second elongated rod, maneuvered via the handle in an opposite direction from the first locking mechanism, so upon maneuvering of the handle, the first and second locking mechanisms move mutually in opposite directions for engagement with respective corresponding first and second locking elements on a door frame.

* * * * *